US011248454B2

(12) United States Patent
Azzouni et al.

(10) Patent No.: US 11,248,454 B2
(45) Date of Patent: Feb. 15, 2022

(54) ELECTRONIC SUBMERSIBLE PUMPS FOR OIL AND GAS APPLICATIONS

(71) Applicant: Saudi Arabian Oil Company

(72) Inventors: Suliman M. Azzouni, Dhahran (SA); Najeeb Al-Abdulrahman, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 373 days.

(21) Appl. No.: 16/276,243

(22) Filed: Feb. 14, 2019

(65) Prior Publication Data

US 2020/0263524 A1 Aug. 20, 2020

(51) Int. Cl.

| | |
|---|---|
| ***E21B 43/12*** | (2006.01) |
| ***E21B 47/00*** | (2012.01) |
| ***E21B 47/008*** | (2012.01) |
| *E21B 23/01* | (2006.01) |
| *E21B 33/12* | (2006.01) |

(52) U.S. Cl.

CPC ..... *E21B 43/128* (2013.01); *E21B 47/008* (2020.05); *E21B 23/01* (2013.01); *E21B 33/12* (2013.01)

(58) Field of Classification Search

CPC ..... E21B 33/12; E21B 43/128; E21B 23/01; E21B 33/127; E21B 47/0007; E21B 47/008

See application file for complete search history.

(56) References Cited

U.S. PATENT DOCUMENTS

| | | | | |
|---|---|---|---|---|
| 4,352,394 | A | 10/1982 | Zehren | |
| 5,404,946 | A * | 4/1995 | Hess | E21B 33/1275 166/187 |
| 6,050,789 | A | 4/2000 | Melby et al. | |
| 6,328,111 | B1 | 12/2001 | Bearden et al. | |
| 6,354,371 | B1 | 3/2002 | O'Blanc | |
| 10,000,983 | B2 | 6/2018 | Jackson et al. | |
| 2003/0170077 | A1* | 9/2003 | Herd | E21B 43/128 405/224.2 |
| 2010/0247335 | A1* | 9/2010 | Atherton | F04D 15/00 417/53 |
| 2016/0061010 | A1 | 3/2016 | Sears et al. | |

(Continued)

FOREIGN PATENT DOCUMENTS

| | | |
|---|---|---|
| WO | 2001073261 | 10/2001 |
| WO | 2009113895 | 9/2009 |

OTHER PUBLICATIONS

International Search Report and Written Opinion issued in International Application No. PCT/US2020/017705 dated Jul. 3, 2020, 13 pages.

(Continued)

*Primary Examiner* — Daniel P Stephenson

(74) *Attorney, Agent, or Firm* — Fish & Richardson P.C.

(57) ABSTRACT

A method of removing fluid from a well using a downhole pump includes deploying the downhole pump to a vertical position within a production tubing disposed in the well, securing the downhole pump to the production tubing at the vertical position, powering a motor of the downhole pump with an electrical line of the downhole pump that extends from a surface of the well and that terminates at a profile of the downhole pump, and activating the motor to pump fluid out of the well.

18 Claims, 3 Drawing Sheets

(56) References Cited

U.S. PATENT DOCUMENTS

2016/0201444 A1* 7/2016 Hardee ..... E21B 43/38
166/265
2020/0263524 A1* 8/2020 Azzouni ..... E21B 43/128

OTHER PUBLICATIONS

Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.
Schlumberger, "The Lifting Business," Offshore Engineer, Mar. 2017, 1 page.
Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue runing tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
slb.com' [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retreived on Nov. 2, 2018, 1 pages.
slb.com' [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
GCC Examination Report issued in Gulf Cooperation Council Application No. GC 2020-39181 dated May 30, 2021, 3 pages.

* cited by examiner

ELECTRONIC SUBMERSIBLE PUMPS FOR OIL AND GAS APPLICATIONS

TECHNICAL FIELD

This disclosure relates to zero footprint electronic submersible pumps for oil and gas applications.

BACKGROUND

Electronic submersible pumps (ESPs) are used in the oil and gas industry as aids for fluid production from wells. A design of a well is typically based on an expected use of an ESP over an entire life of the well. An ESP is placed in a well at a pre-determined depth, depending on an expected grade of oil and presence of water within the well. If the ESP is deployed and/or retrieved on a deployment cable without using a rig, a receptacle that is specifically designed for the ESP is permanently installed within the well at a pre-determined, fixed location during construction of the well, which accordingly determines a single, fixed location of the ESP within the well. The ESP can be attached to the receptacle for installation within the well and detached from the receptacle for replacement once the ESP fails. The receptacle includes control and electrical lines that run to the surface of the well and that are used to control and power the ESP. The receptacle is a costly piece of equipment such that the well, ESP, and receptacle are designed for long-term deployment of an ESP. Such receptacles are prone to failure and typically have a narrow inner diameter that can limit well intervention activities during the life of a well.

In other examples, an artificial nitrogen lifting process is used to aid fluid production from a well. If a well does not flow naturally during a well cleanup operation, a coiled tubing unit can be rigged up and ran into the well for nitrogen lifting of the well. For example, nitrogen can displace fluid in the well to reduce the hydrostatic head, thereby assisting fluid flow out of the well. Coiled tubing is run deep inside of the production tubing (for example, without exiting the production tubing), and nitrogen is pumped into the well to displace fluid from the well. Once the well is flowing, the coiled tubing is pulled out of the well to allow the cleanup operation to resume. The cleanup operation ends once all of the fluid flowing from the well is oil. Deploying nitrogen to the well via the coiled tubing is costly, requires a large equipment footprint, and adds time to the well cleanup operation. Handling the coiled tubing and pressurized nitrogen also introduces safety risks at the well.

SUMMARY

This disclosure relates to an electronic submersible pump (ESP) that is deployable to a desired depth within a well to remove fluids from the well as part of a well cleanup operation. The ESP (for example, a downhole pump) is a mobile assembly that is repositionable within the well as necessitated by changing conditions within the well such that the ESP can provide temporary flowback assistance at a varying depth within the well. The ESP includes a pump motor for pumping fluids out of the well, a connection feature to which the deployment cable can attach, and an inflatable packer for securing the ESP to an inner wall surface of a production tubing at a desired depth within the well. The ESP also includes an electrical line for powering the ESP and optionally includes a control line for transmitting data between the ESP and a surface of the well.

In one aspect, a method of removing fluid from a well using a downhole pump includes deploying the downhole pump to a vertical position within a production tubing disposed in the well, securing the downhole pump to the production tubing at the vertical position, powering a motor of the downhole pump with an electrical line of the downhole pump that extends from a surface of the well and that terminates at a profile of the downhole pump, and activating the motor to pump fluid out of the well.

Embodiments may provide one or more of the following features.

In some embodiments, securing the downhole pump to the production tubing includes inflating a packer of the downhole pump to seal the packer against an inner surface of the production tubing at the vertical position.

In some embodiments, the vertical position is a first vertical position, and the method further includes deflating the packer, moving the downhole pump to a second vertical position that is different from the first vertical position, and re-inflating the packer to seal the packer against the inner surface of the production tubing at the second vertical position.

In some embodiments, the method further includes determining that the well is substantially clean, deflating the packer to release the downhole pump from the production tubing, and withdrawing the downhole pump from the well.

In some embodiments, the electrical line is integrated with a deployment cable on which the downhole pump is deployed.

In some embodiments, the electrical line is a separate component from a deployment cable on which the downhole pump is deployed.

In some embodiments, the method further includes collecting production data from the motor with a control line of the downhole pump that extends from the surface of the well and that terminates at the profile of the downhole pump.

In some embodiments, the control line is integrated with a deployment cable on which the downhole pump is deployed.

In some embodiments, the control line is a separate component from a deployment cable on which the downhole pump is deployed.

In some embodiments, the method further includes removing the fluid from the well using the downhole pump without attaching the downhole pump to a pump receptacle within the production tubing.

In some embodiments, the method further includes removing the fluid from the well using the downhole pump without installing a permanent pump receptacle within the production tubing.

In another aspect, a downhole pump for removing fluid from a well includes a motor for pumping fluids out of the well, an electrical line coupled to the motor for powering the motor, the electrical line extending from a surface of the well and terminating at a profile of the downhole pump, and an inflatable packer coupled to the motor for securing the downhole pump to a production tubing within the well at a vertical position.

Embodiments may provide one or more of the following features.

In some embodiments, the inflatable packer is configured to seal against an inner surface of the production tubing.

In some embodiments, the electrical line is integrated with a deployment cable on which the downhole pump is deployable.

In some embodiments, the electrical line is a separate component from a deployment cable on which the downhole pump is deployable.

In some embodiments, the downhole pump further includes a control line coupled to the motor for collecting production data from the motor.

In some embodiments, the control line extends from the surface of the well and terminates at the profile of the downhole pump.

In some embodiments, the control line is integrated with a deployment cable on which the downhole pump is deployable.

In some embodiments, the control line is a separate component from a deployment cable on which the downhole pump is deployable.

In some embodiments, the downhole pump is configured to be installed in the production tubing without being assembled with a pump receptacle.

The details of one or more embodiments are set forth in the accompanying drawings and description. Other features, aspects, and advantages of the embodiments will become apparent from the description, drawings, and claims.

DETAILED DESCRIPTION

Figure 1:
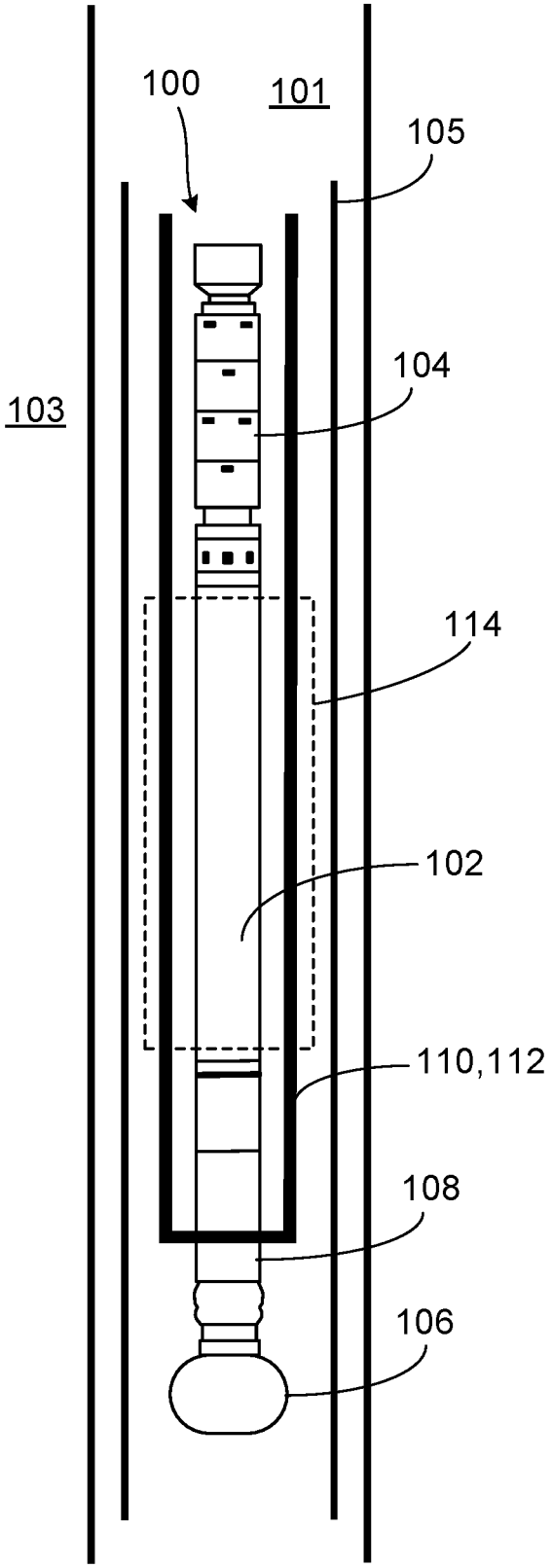
FIG. 1 is a side view of an example electronic submersible pump (ESP) including a motor, a connection head, and electrical and control lines.

FIG. 1 illustrates an electronic submersible pump (ESP) 100 (for example, a downhole pump) that is deployable to a desired depth within a well 101 of a rock formation 103 to remove (for example, to flow back) fluids from the well 101 as part of a well cleanup operation. The ESP 100 is deployable on a coiled deployment cable (for example, a wireline or a tubing) within a production tubing 105 that is installed inside of the well 101. The ESP 100 is a mobile assembly that is repositionable within the well 101 as necessitated by changing conditions within the well 101 such that the ESP 100 can provide temporary flowback assistance at a varying depth within the well 101. Accordingly, the ESP 100 is especially useful for short-term (for example, temporary) well cleanup operations.

The ESP 100 includes a motor 102 (for example, a pump motor) for pumping fluids out of the well 101, a connection head 104 to which the deployment cable can be attached, a packer 106 for securing the ESP 100 to an inner wall surface of the production tubing 105 at the desired depth, and a shaft 108 that connects the motor 102 to the packer 106. The packer 106 is a radially expandable component that can be inflated to seal against the inner wall surface of the production tubing 105. (In FIG. 1, the packer 106 is illustrated in less than fully inflated state.) The ESP 100 also includes an electrical line 110 for powering the ESP 100 and a control line 112 for transmitting control commands from a surface of the well 101 to the ESP 100 and for transmitting data (for example, pump readings intake pressure, fluid temperature, and motor temperature) from the ESP 100 to the surface. In some embodiments, the ESP 100 also includes a sleeve 114 that surrounds the motor 102 and provides protective channels that guide the electrical and control lines 110, 112. In some embodiments, an ESP that is otherwise substantially similar in construction and function to the ESP 100 may not include the sleeve 114 and may alternatively include an elongate channel that extends through a solid body of the ESP for passage of the electrical and control lines 110, 112.

In some embodiments, the electrical and control lines 110, 112 of the ESP 100 may be integrated with the deployment cable on which the ESP 100 is deployed (for example, initially deployed or subsequently shifted) in the well 101. In such cases, the control line 112 can advantageously provide real-time production data during while the ESP 100 is deployed. Example production data parameters that may be informative or useful during deployment include intake pressure, fluid temperature, and motor temperature.

In some embodiments, the electrical and control lines 110, 112 are not integrated with the deployment cable and may be easily connected to other components of the ESP 100 (for example, the connection head 104 or the motor 102) after the ESP 100 is positioned at a desired location (for example, a desired depth) within the well 101, as shown in FIG. 1. Information provided from the control line 112 (for example, whether during deployment of the ESP 100 or after positioning the ESP 100) can be used to determine whether the ESP 100 is positioned at a proper depth within the well or whether the ESP 100 needs to be repositioned. If the ESP 100 needs to be repositioned for efficient cleanup of the well 101, the packer 106 can be deflated to allow shifting of the ESP 100 to the proper position and then re-inflated to secure the ESP 100 to the inner wall surface of the production tubing 105.

In some embodiments, an ESP that is otherwise substantially similar in construction and function to the ESP 100 may not include a control line 112 at all. Although pump readings may not be provided in such cases, functionality of the ESP may be determined from the electrical line 110 and from a flow rate of fluid flowing from the well in which the ESP is deployed.

The ESP 100 typically has a length (excluding a length of the electrical and control lines 110, 112) of about 10 meters (m) to about 37 m and a diameter (excluding a fully inflated diameter of the packer 106) of about 0.08 m to about 0.1 m. The motor 102 typically operates in a range of about 7 liters per second (L/s) to about 17 L/s. The motor 102, the connection head 104, and the shaft 108 are typically made of one or more of carbon steel with coating, nickel alloys, and ni-resist. The packer 106 is typically made of rubber (for example, tetrafluoroethylene propylene rubber or hydrogenated nitrile butadiene rubber).

During a well cleanup operation, a well is opened up and allowed to flow naturally. If the well does not flow naturally, the ESP 100 can be used to perform a well cleanup operation. The ESP 100 flows a well relatively quickly (for example, as compared to nitrogen lifting), as the ESP 100 does not introduce nitrogen (for example, which is conventionally used in lifting a well) into a well. Rather, the well can begin to flow as soon as the ESP 100 is deployed and switched on. The cleanup operation ends once substantially all of the fluid flowing from the well is oil. Furthermore, the ESP 100 advantageously has a smaller, easier to handle footprint that can be relatively quickly run in a well (for example, over a duration of about 8 hours (h) to about 12 h). In contrast, the coil tubing for nitrogen lifting is costly, bulky, and therefore requires a long time to rig up. Usage of the ESP 100 also enhances rig safety, as the ESP 100 can be stopped at any time to halt fluid flow from a well, whereas unloading a well using nitrogen lifting requires pulling of the coil tubing out of the well after pumping killing fluid in the well to halt fluid flow from the well.

Additionally, because the ESP 100 includes electrical and control lines 110, 112 that are integral with the ESP 100, usage of the ESP 100 does not require installation of a permanent receptacle that includes delicate power and control lines, as do conventional ESPs. Deploying such a receptacle in a well requires a significant amount of time (for example, about 8 h to about 12 h) for slowly running the delicate lines in the well. In contrast, the ESP 100 is a zero footprint assembly that does not require installation of a permanent footprint (for example, a permanent receptacle) in the well 101, saving a significant amount of operational time. The electrical and control lines 110, 112 of the ESP 100 terminate vertically at a profile of the ESP 100 (for example, at a component body, housing, or frame of the ESP 100, such as just below the motor 102) as opposed to extending outside of a profile of the ESP 100 to a surrounding receptacle. That is, the ESP 100 is movable to provide temporary flowback assistance at an optimal location (for example, a vertical position) where needed in the well 101, which is not possible with use of conventional ESPs that are designed for fixed depth positioning of an ESP within a well.

Since the ESP 100 does not require docking to a permanent receptacle in a well, a design of the well may be changed in various ways in the future for enhancing production from the well. For example, the well may be converted to a configuration for a permanent receptacle and ESP at a future time without making changes to a lower portion of the production tubing, if desired. Furthermore, usage of the ESP 100 eliminates the need for a workover rig at a well for changing a permanent receptacle or maintaining it.

Figure 2:
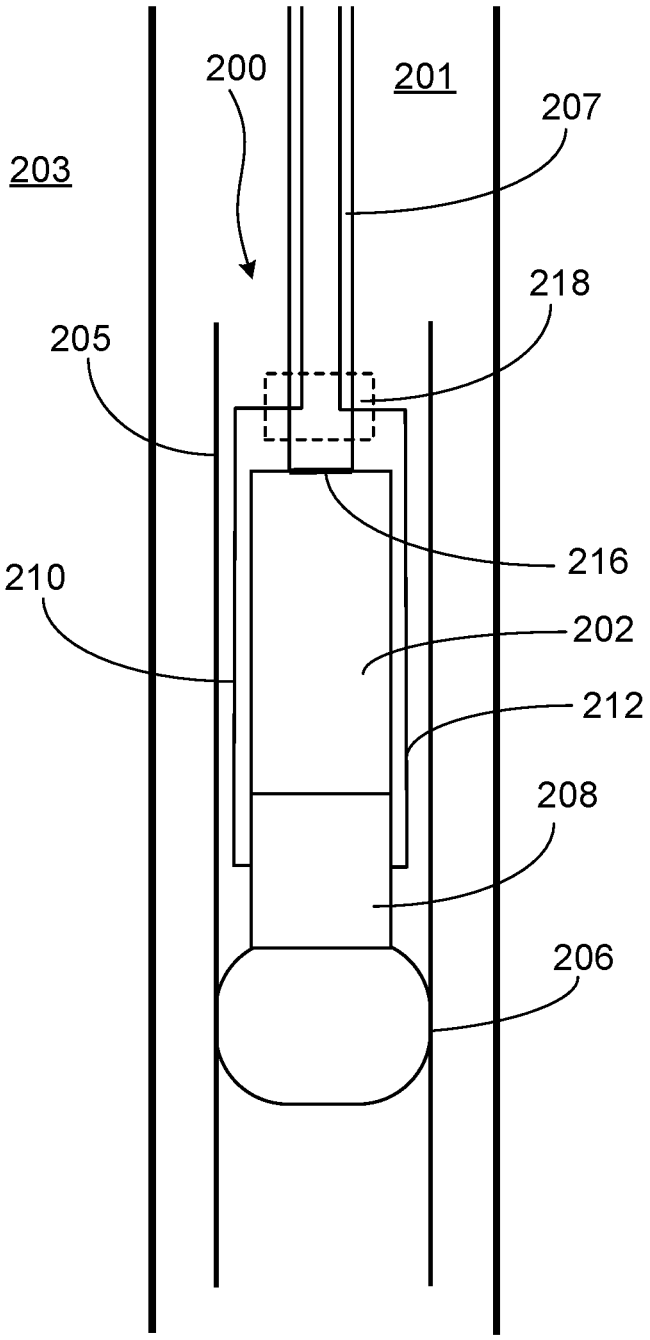
FIG. 2 is a side view of an example ESP including an integrated motor body and electrical and control lines coupled to a deployment cable.

While the ESP 100 has been described and illustrated as including a motor 102 that is separate from the connection head 104, in some embodiments, an ESP includes a connection feature that is integral with a motor body. For example, FIG. 2 illustrates an ESP 200 (for example, a downhole pump) that does not include a separate connection head and motor, but that instead includes a motor 202 (for example, a pump motor) with an integral connection feature 216 to which a coiled deployment cable 207 (for example, a wireline or a tubing) can be attached. In some embodiments, the integral connection feature 216 allows deployment of the ESP 200 via various types of deployment mechanisms (for example, coil tubing or wire line), which allows flexibility in deployment capabilities. For example, coil tubing is relatively more rigid and can reach deeper depths, while wire line can be more quickly installed and is more agile. The deployment mechanism is also flexible in that various grades of coils and wire line cables can be utilized, depending on deployment parameters, such as those related to a weight of an ESP or a design of the well. The ESP 200 is otherwise substantially similar in construction, function, and advantages to the ESP 100 and therefore is deployable to a desired depth within a well 201 of a rock formation 203 to remove fluids from the well 201 as part of a well cleanup operation. Accordingly, the ESP 200 includes a packer 206, a shaft 208, an electrical line 210, and a control line 212 that are respectively, substantially similar in construction and function to the packer 106, the shaft 108, the electrical line 110, and the control line 112, as discussed above with respect to the ESP 100.

In the example illustration of FIG. 2, the electrical and control lines 210, 212 are coupled to (for example, run along) the coiled deployment cable 207 and separate from the coiled deployment cable 207 at a region 218 just above the motor 202. In some embodiments, an ESP that is otherwise substantially similar in construction and function to the ESP 200 may include a control line 212 that is separate from the deployment cable 207 or may not include a control line 212 at all, as discussed above with respect to the ESP 100. In some embodiments, an ESP that is otherwise substantially similar in construction and function to the ESP 200 or the ESP 100 may not include an electrical line 110, 210. Such an ESP may not be deployed on a deployment cable and may instead be deployed on an e-coil tubing that provides power to the ESP.

Figure 3:
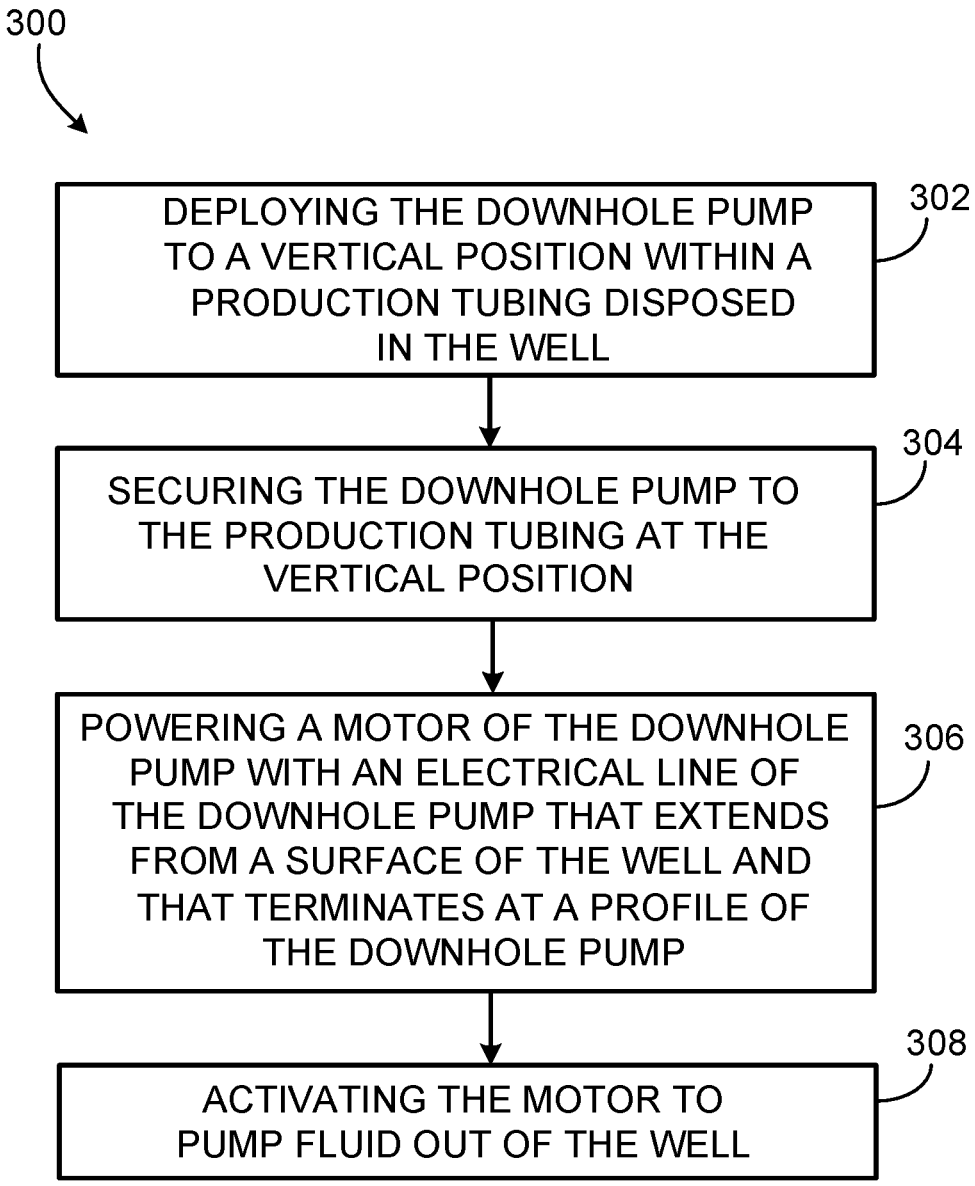
FIG. 3 is a flow chart illustrating an example method of removing fluid from a well using an ESP.

FIG. 3 is a flow chart illustrating an example method 300 of removing fluid from a well (for example, the well 101, 201) using a downhole pump (for example, the ESP 100, 200). In some embodiments, the method 300 includes deploying the downhole pump to a vertical position within a production tubing (for example, the production tubing 105, 205) disposed in the well (302). In some embodiments, the method 300 further includes securing the downhole pump to the production tubing at the vertical position (304). In some embodiments, the method 300 further includes powering a motor (for example, the motor 102, 202) of the downhole pump with an electrical line (for example, the electrical line 110, 210) of the downhole pump that extends from a surface of the well and that terminates at a profile of the downhole pump (306). In some embodiments, the method 300 further includes activating the motor to pump fluid out of the well.

While the above-discussed ESPs 100, 200 have been described and illustrated as including certain dimensions, sizes, shapes, arrangements, and materials, in some embodiments, an ESP that is otherwise substantially similar in construction and function to either of the ESPs 100, 200 may include one or more different dimensions, sizes, shapes, arrangements, and materials.

Other embodiments are also within the scope of the following claims.

What is claimed is:

1. A method of removing fluid from a well using a downhole pump, the method comprising:

deploying the downhole pump to a vertical position within a production tubing disposed in the well;

securing the downhole pump to the production tubing at the vertical position;

powering a motor of the downhole pump with an electrical line of the downhole pump that extends from a surface of the well to the downhole pump;

activating the motor to pump fluid out of the well, collecting production data from the motor while the fluid is pumped out with a control line of the downhole pump that extends from the surface to the downhole pump, wherein the electrical line and the control line terminate at a profile of the downhole pump above a packer of the downhole pump to allow for powering the downhole pump and controlling the downhole pump from the surface; and removing the fluid from the well using the downhole pump without having installed a permanent pump receptacle within the production tubing beneath the downhole pump.

2. The method of claim 1, wherein securing the downhole pump to the production tubing comprises inflating a packer of the downhole pump to seal the packer against an inner surface of the production tubing at the vertical position.

3. The method of claim 2, wherein the vertical position is a first vertical position, the method further comprising:

deflating the packer;

moving the downhole pump to a second vertical position that is different from the first vertical position; and re-inflating the packer to seal the packer against the inner surface of the production tubing at the second vertical position.

4. The method of claim 2, further comprising:

determining that the well is substantially clean;

deflating the packer to release the downhole pump from the production tubing; and withdrawing the downhole pump from the well.

5. The method of claim 1, wherein the electrical line is integrated with a deployment cable on which the downhole pump is deployed.

6. The method of claim 1, wherein the electrical line is a separate component from a deployment cable on which the downhole pump is deployed.

7. The method of claim 1, wherein the control line is integrated with a deployment cable on which the downhole pump is deployed.

8. The method of claim 1, wherein the control line is a separate component from a deployment cable on which the downhole pump is deployed.

9. The method of claim 1, further comprising removing the fluid from the well using the downhole pump without attaching the downhole pump to a pump receptacle within the production tubing.

10. The method of claim 1, wherein the electrical line and the control line extend laterally along the downhole pump within a protective sleeve that surrounds the downhole pump.

11. A downhole pump for removing fluids from a well, the downhole pump comprising:

a motor for pumping fluids out of the well;

an electrical line coupled to the motor for powering the motor and extending from a surface of the well;

a control line coupled to the motor for collecting production data from the motor and extending from the surface of the well; and an inflatable packer coupled to the motor for securing the downhole pump to a production tubing within the well at a vertical position, wherein the electrical line and the control line terminate at a profile of the downhole pump above the inflatable packer to allow for powering the downhole pump and controlling the downhole pump from the surface, such that downhole pump is configured to be installed in the production tubing without being assembled with a permanent downhole pump receptacle.

12. The downhole pump of claim 11, wherein the inflatable packer is configured to seal against an inner surface of the production tubing.

13. The downhole pump of claim 11, wherein the electrical line is integrated with a deployment cable on which the downhole pump is deployable.

14. The downhole pump of claim 11, wherein the electrical line is a separate component from a deployment cable on which the downhole pump is deployable.

15. The downhole pump of claim 11, wherein the control line is integrated with a deployment cable on which the downhole pump is deployable.

16. The downhole pump of claim 11, wherein the control line is a separate component from a deployment cable on which the downhole pump is deployable.

17. The downhole pump of claim 11, wherein the electrical line and the control line extend laterally along the downhole pump.

18. The downhole pump of claim 17, further comprising a sleeve that surrounds at least a portion of the electrical line and the control line.

* * * * *